US009924739B2

(12) United States Patent
Mishra et al.

(10) Patent No.: US 9,924,739 B2
(45) **Date of Patent: *Mar. 27, 2018**

(54) MOIST TOBACCO PRODUCT AND METHOD OF MAKING

(71) Applicant: Philip Morris USA Inc., Richmond, VA (US)

(72) Inventors: Munmaya K. Mishra, Richmond, VA (US); William R. Sweeney, Richmond, VA (US); Shensheng Liu, Richmond, VA (US); Kenneth A. Newman, Prince George, VA (US); Steven J. Hovjacky, Chesterfield, VA (US)

(73) Assignee: Philip Morris USA Inc., Richmond, VA (US)

( * ) Notice: Subject to any disclaimer, the term of this patent is extended or adjusted under 35 U.S.C. 154(b) by 180 days.

This patent is subject to a terminal disclaimer.

(21) Appl. No.: 14/691,879

(22) Filed: Apr. 21, 2015

(65) Prior Publication Data

US 2015/0223516 A1 Aug. 13, 2015

Related U.S. Application Data

(62) Division of application No. 11/984,041, filed on Nov. 13, 2007, now Pat. No. 9,032,971.

(Continued)

(51) Int. Cl.
*A24B 15/00* (2006.01)
*A24B 15/18* (2006.01)

(Continued)

(52) U.S. Cl.
CPC ..... *A24B 15/18* (2013.01); *A24B 13/00* (2013.01); *A24B 15/283* (2013.01); *A24B 15/30* (2013.01)

(58) Field of Classification Search
None
See application file for complete search history.

(56) References Cited

U.S. PATENT DOCUMENTS 865,026 A 9/1907 Ellis
904,521 A 11/1908 Ellis (Continued)

FOREIGN PATENT DOCUMENTS

WO 03/053175 A2 7/2003
WO 2006004480 A1 1/2006

(Continued)

OTHER PUBLICATIONS

International Search Report and Written Opinion dated Sep. 17, 2008 for PCT/IB2007/004216.

(Continued)

*Primary Examiner* — Michael H Wilson
*Assistant Examiner* — Phu Nguyen
(74) *Attorney, Agent, or Firm* — Buchanan Ingersoll & Rooney PC

(57) ABSTRACT

A portioned moist tobacco product with a super-hydrated membrane coating and method of manufacturing is disclosed. The super-hydrated membrane coating is formed by ionic cross-linking using two polymers. The soluble component of the super-hydrated membrane coating dissolves upon placement in the mouth, while the insoluble component maintains the tobacco within the coating for the duration of the use of the product. The moist tobacco product is soft and flexible so as to fit comfortably in an oral cavity when placed therein.

20 Claims, 4 Drawing Sheets

Related U.S. Application Data

(60) Provisional application No. 60/858,951, filed on Nov. 15, 2006.

(51) Int. Cl.

| | |
|---|---|
| ***A24B 13/00*** | (2006.01) |
| ***A24B 15/28*** | (2006.01) |
| ***A24B 15/30*** | (2006.01) |

(56) References Cited

U.S. PATENT DOCUMENTS

| | | | | |
|---|---|---|---|---|
| 1,376,586 | A | 5/1921 | Schwartz | |
| 4,513,756 | A | 4/1985 | Pittman et al. | |
| 4,543,370 | A | 9/1985 | Porter et al. | |
| 4,545,392 | A | 10/1985 | Sensabaugh, Jr. et al. | |
| 4,624,269 | A | 11/1986 | Story et al. | |
| 4,683,256 | A | 7/1987 | Porter et al. | |
| 4,817,640 | A | 4/1989 | Summers | |
| 4,917,161 | A | 4/1990 | Townend | |
| 4,975,270 | A | 12/1990 | Kehoe | |
| 5,092,352 | A | 3/1992 | Sprinkle, III et al. | |
| 5,175,277 | A | 12/1992 | Rakitsky et al. | |
| 5,387,416 | A | 2/1995 | White et al. | |
| 5,612,053 | A * | 3/1997 | Baichwal | A61K 9/146 424/434 |
| 6,162,516 | A | 12/2000 | Derr | |
| 6,325,859 | B1 | 12/2001 | De Ross et al. | |
| 7,032,601 | B2 | 4/2006 | Atchley et al. | |
| 8,539,958 | B2 | 9/2013 | Mishra et al. | |
| 2003/0224090 | A1 | 12/2003 | Pearce et al. | |
| 2004/0118421 | A1 | 6/2004 | Hodin et al. | |
| 2004/0118422 | A1 | 6/2004 | Lundin et al. | |
| 2004/0247649 | A1 | 12/2004 | Pearce et al. | |
| 2004/0247744 | A1 | 12/2004 | Pearce et al. | |
| 2004/0247746 | A1 | 12/2004 | Pearce et al. | |
| 2005/0003048 | A1 | 1/2005 | Pearce et al. | |
| 2005/0061339 | A1 | 3/2005 | Hansson et al. | |
| 2005/0067726 | A1 | 3/2005 | Yan et al. | |
| 2005/0100640 | A1 | 5/2005 | Pearce | |
| 2005/0244521 | A1 * | 11/2005 | Strickland | A24B 13/00 424/751 |
| 2006/0073190 | A1 | 4/2006 | Carroll et al. | |
| 2006/0144412 | A1 | 7/2006 | Mishra et al. | |
| 2006/0191548 | A1 | 8/2006 | Strickland et al. | |
| 2007/0003663 | A1 | 1/2007 | Jani et al. | |
| 2007/0012328 | A1 | 1/2007 | Winterson et al. | |
| 2007/0062549 | A1 | 3/2007 | Holton, Jr. et al. | |
| 2007/0122455 | A1 | 5/2007 | Meyers et al. | |
| 2007/0186844 | A1 | 8/2007 | Weisleder et al. | |
| 2007/0186941 | A1 | 8/2007 | Holton, Jr. et al. | |
| 2007/0186942 | A1 | 8/2007 | Strickland et al. | |
| 2007/0186943 | A1 | 8/2007 | Strickland et al. | |
| 2007/0186944 | A1 | 8/2007 | Strickland et al. | |
| 2007/0190157 | A1 | 8/2007 | Sanghvi et al. | |
| 2008/0029110 | A1 | 2/2008 | Dube et al. | |
| 2008/0029116 | A1 | 2/2008 | Robinson et al. | |
| 2008/0029117 | A1 | 2/2008 | Mua et al. | |
| 2008/0081071 | A1 | 4/2008 | Sanghvi et al. | |
| 2008/0202533 | A1 | 8/2008 | Mishra et al. | |
| 2009/0038631 | A1 | 2/2009 | Mishra et al. | |
| 2009/0301505 | A1 | 12/2009 | Liu et al. | |
| 2011/0083688 | A1 | 4/2011 | Mishra et al. | |
| 2011/0232662 | A1 | 9/2011 | Liu et al. | |

FOREIGN PATENT DOCUMENTS

| | | | |
|---|---|---|---|
| WO | 2006065192 | A1 | 6/2006 |
| WO | 2006105173 | A2 | 10/2006 |
| WO | 2008/059375 | A2 | 5/2008 |

OTHER PUBLICATIONS

International Search Report and Written Opinion dated Mar. 30, 2009 for PCT/IB2008/002883.

International Search Report and Written Opinion dated Aug. 25, 2009 for PCT/IB2009/000385.

International Preliminary Report on Patentability and Written Opinion dated May 19, 2009 for PCT/IB2007/004216.

International Preliminary Report on Patentability dated Aug. 10, 2010 for International Application No. PCT/IB2009/00385.

* cited by examiner

MOIST TOBACCO PRODUCT AND METHOD OF MAKING

CROSS REFERENCE TO RELATED APPLICATION

This application is a divisional of U.S. application Ser. No. 11/984,041, filed Nov. 13, 2007 for MOIST TOBACCO PRODUCT AND METHOD OF MAKING which claims priority under 35 U.S.C. § 119(e) to U.S. provisional Application No. 60/858,951, filed on Nov. 15, 2006, the entire content of each is incorporated herein by reference.

BACKGROUND

Many adult tobacco consumers enjoy dipping or chewing flavored and unflavored tobacco with high moisture levels. The moisture of the product provides good flavor and is comfortable in the mouth. In addition, the moisture also allows a user to portion the tobacco product and maintain coherence of the portion during placement.

However, portioning moist tobacco with the fingers is often messy and can disperse the tobacco product in the mouth to some extent.

Pouched tobacco products are available, but many users find the pouches to be uncomfortable due to the texture of the material used to form the pouch. Also, many user's feel that the pouch material causes a reduction in the overall flavor of the product and a slow initial flavor release upon insertion in the user's mouth.

Often, the pouched products are small and provide less tobacco than a user of loose tobacco typically desires. Therefore, some users place multiple pouches in their mouths, thereby exacerbating the discomfort caused by some of the pouch materials.

Thus, there remains a need in the art for a moist tobacco product that provides rapid flavor delivery yet fits comfortably in a user's mouth.

SUMMARY

Provided is a moist tobacco product with a super-hydrated membrane coating, which includes a soluble component and an insoluble component. Preferably, the super-hydrated membrane coating is a single layer, partially cross-linked coating.

In a preferred embodiment, the super-hydrated membrane coating is formed from a multi-component solution containing at least two polymers. The insoluble component is preferably formed by a chemically cross-linked polymer, e.g. a polymer cross-linked with a bivalent metal ion salt or a monovalent metal ion salt. The soluble component is preferably formed by a non-cross-linked polymer, which quickly dissolves in the oral cavity.

In use, the soluble component dissolves after insertion in a user's mouth, thereby creating pores in a polymer network of the insoluble component that allow the tobacco juices and flavors to pass through the super-hydrated membrane coating. The insoluble component provides a soft, compliant coating, which maintains the integrity of the tobacco portion contained within the coating throughout the duration of the tobacco consumption experience.

In a preferred embodiment, the tobacco product includes a portion of moist tobacco contained within a super-hydrated membrane coating.

Also provided is a method of manufacturing the tobacco product.

Preferably, the super-hydrated membrane coating is formed by ionic cross-linking. In an automated process, the coating can be formed by sequentially spraying a multi-component polymer solution and a cross-linking solution onto the tobacco material.

Alternatively, tobacco material, such as a molded shape of moist smokeless tobacco (MST), may be dipped in a solution containing the soluble and insoluble components to form a coating.

In one embodiment, the super-hydrated membrane coating includes an insoluble component and a rapidly dissolving soluble component.

In another embodiment, the dissolution rate of the soluble component of the coating may be altered by changing the proportion of insoluble, cross-linked components with respect to the soluble, non-cross-linked components of the coating.

The super-hydrated membrane coating is preferably designed to provide a pre-portioned tobacco product and facilitate placement of the tobacco product in the mouth. In a preferred embodiment, the coating may also enhance cohesiveness of the tobacco product when inserted in the mouth.

In a preferred embodiment, the soluble component of the super-hydrated membrane coating provides additional flavor carrying moisture upon dissolution. The coating may include additives such as flavors, sweeteners, and chemesthesis agents that are rapidly or slowly released to provide enhanced characteristics to the moist tobacco product contained within the coating. The flavors, sweeteners, and chemesthesis agents may be bound to the insoluble component of the coating, the soluble component of the coating, or the enclosed tobacco material. Additives bound to the insoluble component provide prolonged release of the additives, while additives bound to the soluble component provide rapid release of the additives.

Preferably, the coating is aesthetically pleasing, non-tacky, and pleasant to touch, while being strong enough to maintain the integrity of the portion of moist tobacco material contained inside the coating during insertion and placement in the mouth. The coating is preferably clear, but fillers may be added to provide the coating with a desired color or appearance.

DETAILED DESCRIPTION

As described herein, a moist tobacco product has been developed wherein a coating surrounds a molded shape of moist tobacco. It has been found that some coatings of moist smokeless tobacco exhibit various drawbacks with respect to flavor release and/or ability to contain moist smokeless tobacco. For instance, it has been determined that some coating materials are not comfortable in a user's mouth, while others provide too rapid a flavor release and/or are too dissolvable and allow tobacco to migrate into a user's mouth.

To overcome such drawbacks, a super-hydrated membrane coating has been developed, which allows the flow of flavor juices from the moist smokeless tobacco and added flavors, while maintaining coherence of the tobacco and providing a smooth and comfortable mouth feel.

Figure 1:
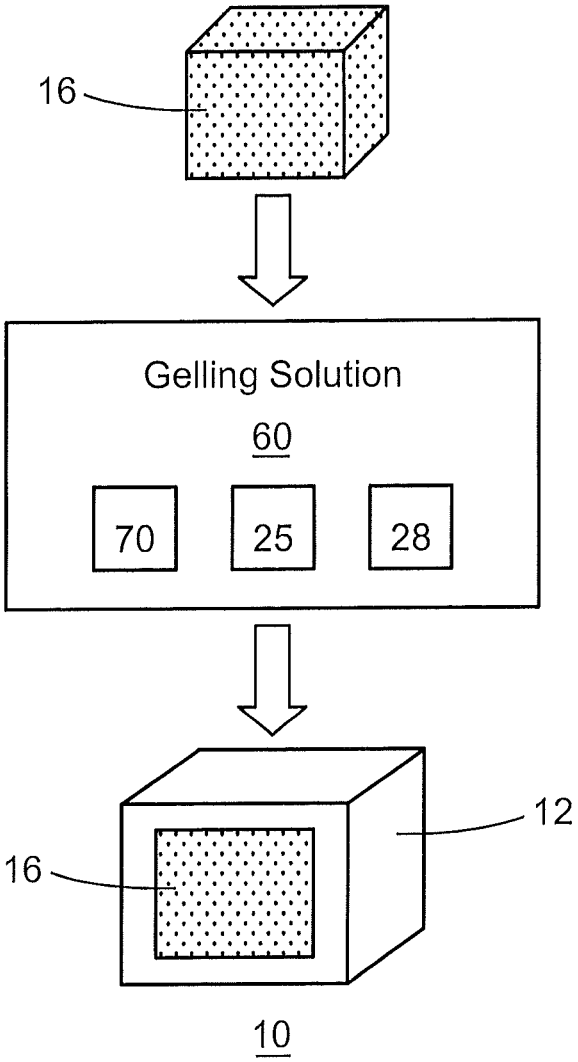
FIG. 1 is a simplified illustration of a gel coating method.

In one study, a gel coating was investigated wherein a gel technique was used to create a coating as shown in FIG. 1 and described in Example 1. A gelling polymer 70, such as agar, was dissolved in deionized water 25 and heated to create a hot gelling solution 60. Additives 28 such as sweeteners, flavors, or chemesthesis agents may be added.

A portion of moist snuff tobacco material 16 was dipped into the hot gelling solution 60 and removed. The portion was then exposed to air so that the gel formed on the surface as the temperature reached ambient.

Example 1

To form a tobacco product having a super-hydrated membrane coating using simple gelation techniques, 1.5 g agar was dissolved in 98.5 g of deionized water at about 50° to 100° C. The hot agar solution was transferred to a plastic pan. 2.5 g of moist tobacco was molded into a rectangular shape. The moist tobacco was dipped into the above described hot agar solution and then quickly removed. The sample was exposed to air and an agar gel formed on the surface as the temperature reached ambient.

While the gel method can produce a comfortable tobacco product with a super-hydrated coating, when the coating is dissolved during use, an excessive amount of water may be released from the coating into the user's mouth, thus rendering the product unacceptable to the consumer.

In addition, since the coating may fully dissolve upon placement in the mouth, the tobacco material can break free and float loosely throughout the mouth thereby causing discomfort to the user and difficulty in removing the tobacco from the mouth following use.

Figure 2:
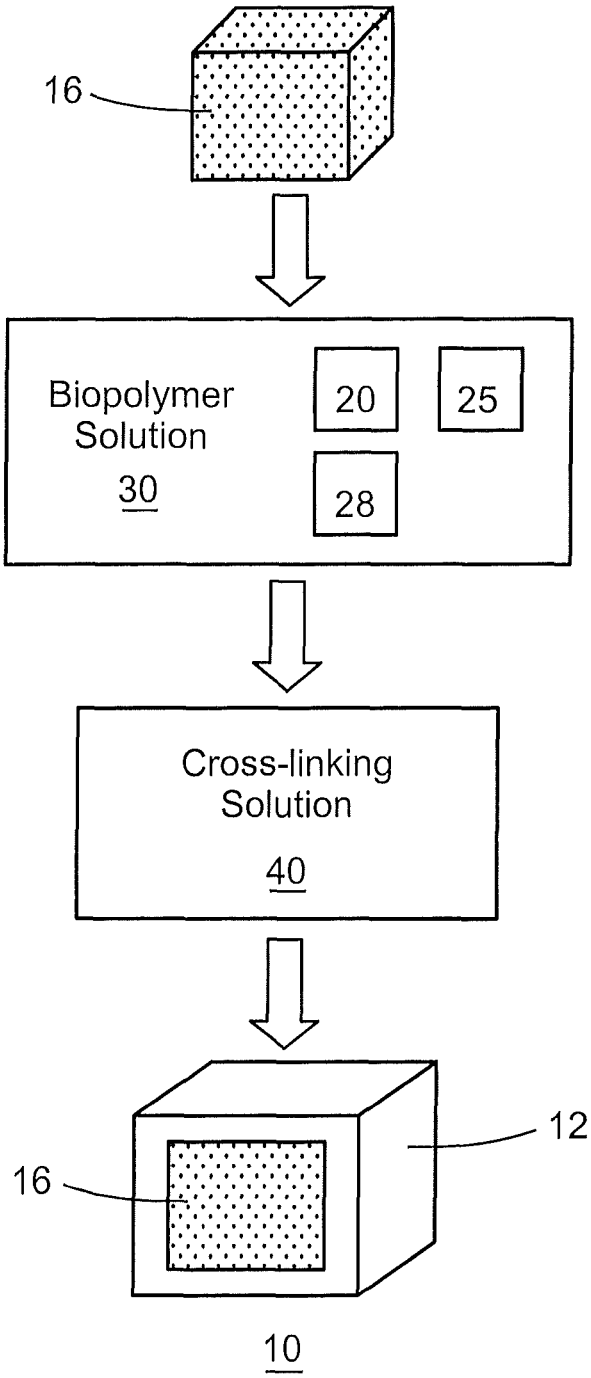
FIG. 2 is a simplified illustration of a coating method using a single polymer.

In another study, a super-hydrated membrane coating was produced having a tough coating that impeded the flow of tobacco juices and flavors from inside the coating to the user's mouth. The second super-hydrated membrane coating included an insoluble component that was formed from a single polymer 20, dissolved in deionized water 25 and heated to create a hot gelling solution 30, and a cross-linking agent, in the form of a cross-linking solution 40, as seen in FIG. 2 and described in Example 2. The polymer solution 30 optionally includes additives 28.

Example 2

To form a super-hydrated membrane coating by cross-linking of a single polymer, a round bottom flask was charged with 1.5 g alginate and 98.5 mL of deionized water. The mixture was stirred and heated to about 50° C. to 100° C. to dissolve the polymer. The solution was cooled down to room temperature and then transferred to a plastic pan. A cross-linking solution of 2.0 wt % calcium lactate was prepared. 2.5 g of moist tobacco was first molded into a rectangular shape and then dipped into the above described polymer solution. The coated moist tobacco was then cross-linked with the 2.0 wt % cross-linking solution. The sample was exposed in air to evaporate moisture until the weight of the coated moist tobacco product reached about 2.5 g to 2.8 g.

The resulting tobacco product had a tough, insoluble coating that did not allow the unrestricted flow of tobacco juices and flavors from inside the tobacco product to the user's mouth. While the resulting cross-linked coating held the tobacco intact inside the coating for the duration of the oral experience, the coating inhibited desired flavor delivery of the tobacco material and was uncomfortable in the oral cavity.

In a third study, a semi-dissolvable, super-hydrated membrane coating was prepared from a multi-component polymer. In a preferred embodiment, a monolayer, super-hydrated membrane coating can be used to enclose a portion of moist tobacco by coating the tobacco with a two polymer solution.

Figure 3:
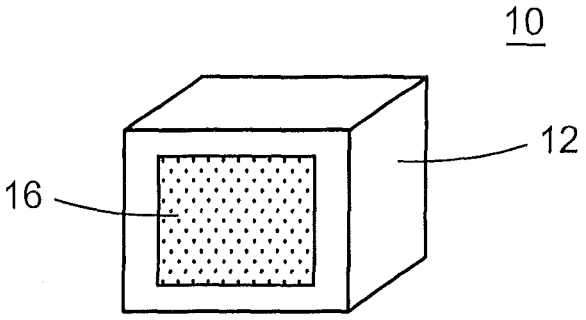
FIG. 3 illustrates a cross-sectional view of one embodiment of a tobacco product with a super-hydrated, monolayer membrane coating.

FIG. 3 illustrates a cross-sectional view of one embodiment of a tobacco product 10 with a super-hydrated, monolayer membrane coating 12. The super-hydrated membrane coating 12 is a single layer, bicomponent coating that coats a portion of tobacco material 16. The bicomponent coating 12 includes a soluble polymer and an insoluble polymer, which may be the same or different polymer. Preferably, the tobacco material 16 is a molded portion of moist snuff tobacco.

Preferably, the tobacco product 10 is sized and configured to fit comfortably between the user's cheek and gum. The tobacco product 10 may be formed in many shapes including, without limitation, spheres, rectangles, oblong shapes, crescent shapes, ovals, and cubes. In a preferred embodiment, the coated tobacco product is rectangular and weighs about 2.5 g to 3.0 g.

The super-hydrated membrane coating 12 preferably creates a porous network of an insoluble polymer after the soluble component dissolves in a user's mouth. Preferably, the first component is a soluble component that dissolves rapidly in a user's mouth such that the second component, which is preferably the insoluble component, remains intact throughout use of the tobacco product.

Preferably, the soluble component is formed by a non-cross-linkable polymer. Also preferably, the insoluble component is formed by a chemically, cross-linkable polymer reacted with a cross-linking agent.

The polymers of the soluble component and insoluble component may be natural or synthetic. Preferably the polymers are hydrocolloids. More preferably, the polymers are polysaccharides.

In a preferred embodiment, the cross-linking agent is a monovalent metal ion salt or bivalent metal ion salt.

Suitable non-chemically-cross-linkable polymers include, without limitation, starch, dextrin, gum arabic, guar gum, chitosan, cellulose, polyvinyl alcohol, polylactide, gelatin, soy protein, and whey protein.

Suitable chemically, cross-linkable polymers include, without limitation, alginate, pectin, carrageenan, and modified polysaccharides with crosslinkable functional groups. The preferred cross-linkable polymer is alginate.

While, both monovalent and bivalent metal ion salts may be used, preferably a bivalent metal ion salt is used. Suitable bivalent metal ion salts include, without limitation, calcium lactate and calcium chloride. Calcium lactate is preferred since it is approved for use in food products.

Once the soluble component of the coating dissolves, pores are created in a polymer network through which the tobacco juices and flavors flow. Flavors and water are released into the user's mouth as the soluble component of the coating dissolves. The tobacco flavors and juices are then released through the pores so that the flavor experience is seamless from beginning to end. In a preferred embodiment, the bulk density of the coated tobacco product is about $1.0 \pm 0.2$ g/cm$^3$.

Preferably, the pores, created when the soluble component of the coating dissolves, are large enough to allow the unencumbered flow of juices, while remaining small enough to prevent shreds or particles of tobacco from traveling through the pores and into the user's mouth.

In a preferred embodiment, the coating encloses a pre-portioned tobacco material 16. Also, the coating allows the tobacco juices and flavors to leach out of the coating, while still remaining intact to hold the tobacco within the coating through the duration of tobacco use. The coating provides a soft compliant feel to the tongue and mouth tissues.

Because the soluble component of the coating dissolves quickly, the sensory experience associated with moist tobacco use is rapid and unencumbered.

Once the soluble component of the super-hydrated membrane coating 12 dissolves or disintegrates, additional moisture and/or flavors are released into the user's mouth. Thereafter, the flavors and tobacco juices pass through the coating to provide an uninterrupted flavor experience to the user.

In a preferred embodiment, the super-hydrated membrane coating 12 may be provided with a desired rate of dissolution of the soluble component of the coating by altering the proportion of the soluble component to the insoluble component.

In another embodiment, the super-hydrated membrane coating 12 includes flavors, sweeteners, and/or a chemesthesis agent. The flavors, sweeteners and chemesthesis agents can be released upon dissolution of the soluble component of the super-hydrated membrane coating. If slow release of certain flavor additives is desired, such additives can be incorporated in the insoluble component. Preferably, the released flavors enhance the oral sensorial experience of the tobacco product user.

In a preferred embodiment, the super-hydrated membrane coating is not messy or sticky to the touch. Because at least two polymers are used to create the coating, when a user touches the coating, the polymers do not disassociate from one another. Therefore, the coating is not sticky when the product is removed from a package and placed in the mouth.

Preferably, the final tobacco product 10 weighs about 2.5 to 3.0 grams. The weight is predominately based on the amount of tobacco material used since the weight of the super-hydrated membrane coating is small as compared to that of the tobacco. In an embodiment, the shaped tobacco product may be up to about 1.5 inches long, up to 1 inch in height, and up to ¾ inch in width. Preferably, the tobacco product 10 is flexible, compressible, and capable of conforming to the shape of the oral cavity.

Exemplary tobacco materials 16 that may be coated with a super-hydrated, monolayer membrane coating can include cut or ground tobacco. Additionally, flavor additives and/or humectants may be included in the tobacco materials 16. The tobacco can have the composition and attributes of conventional moist snuff tobacco.

Examples of suitable types of tobacco materials 16 that may be used include, but are not limited to, flue-cured tobacco, Burley tobacco, Maryland tobacco, Oriental tobacco, rare tobacco, specialty tobacco, reconstituted tobacco, agglomerated tobacco fines, blends thereof and the like. Preferably, the tobacco material 16 is pasteurized. Some or all of the tobacco material 16 may be fermented.

The tobacco material 16 may be provided in any suitable form, including shreds and/or particles of tobacco lamina, processed tobacco materials, such as volume expanded or puffed tobacco, or ground tobacco, processed tobacco stems, such as cut-rolled or cut-puffed stems, reconstituted tobacco materials, blends thereof, and the life. Genetically modified tobacco may also be used.

Additionally, the tobacco material may also include a supplemental amount of vegetable or plant fibers or particles, such as particles of shreds of lettuce, cotton, flax, beet fiber, cellulosic fibers, blends thereof and the like.

In one embodiment, the tobacco material is completely disintegrable so that once the soluble component of the coating dissolves and tobacco material has disintegrated, a user may chew and ingest the remaining insoluble component so that nothing remains in the user's mouth.

Humectants can also be added to the tobacco material 16 to help maintain the moisture levels in the portioned tobacco product. Examples of humectants that can be used with the tobacco material 16 include glycerol, glycerine, triethylene glycol and propylene glycol. The humectants may also be provided for a preservative effect, as the water activity of the product can be decreased with inclusion of a humectant. In turn, the opportunity for growth of micro-organisms is diminished. Additionally, humectants can be used to provide a higher moisture feel to a drier tobacco component.

Suitable flavor additives and aromas for inclusion in the super-hydrated membrane coating 12 or the tobacco material 16 include, but are not limited to, any natural or synthetic flavor or aroma, such as tobacco, smoke, menthol, peppermint, spearmint, bourbon, scotch, whiskey, cognac, hydrangea, lavender, chocolate, licorice, citrus and other fruit flavors, such as apple, peach, pear, cherry, plum, orange and grapefruit, gamma octalactone, vanillin, ethyl vanillin, breath freshener flavors, spice flavors such as cinnamon, clove, nutmeg, sage, anise, and fennel, methyl salicylate, linalool, jasmine, coffee, bergamot oil, geranium oil, lemon oil, and ginger oil. Other suitable flavors and aromas may include flavor compounds selected from the group consisting of an acid, an alcohol, an ester, and aldehyde, a ketone, a pyrazine, combinations or blends thereof and the like. Suitable flavor compounds may be selected, for example, from the group consisting of phenylacetic acid, solanone, megastimatrienone, 2-heptanone, benzylalcohol, cis-3-hexenyl acetate, valeric acid, valeric aldehyde, ester, terpene, sequiterpene, nootkatone, maltol, damascenone, pyrazine, lactone, anethole, isovaleric acid, combinations thereof and the like.

The super-hydrated membrane coating 12 may also include additives such as natural or artificial sweeteners. Preferred sweeteners include, without limitation, water soluble sweeteners, such as monosaccharides, disaccharides, and polysaccharides, such as xylose, ribose, sucrose, maltose, fructose, glucose, and mannose.

Additives such as chemesthesis agents may also be included in the super-hydrated membrane coating. Suitable chemesthesis agents for inclusion in the super-hydrated membrane coating include, without limitation, capsaicin, tannins, mustard oil, wintergreen oil, cinnamon oil, allicin, quinine, citric acid, and salt.

In one embodiment, the super-hydrated membrane coating is created via ionic cross-linking. One or more polymers are used to create a single layer, thin membrane coating over a portion of a tobacco material.

In a preferred embodiment, a multi-component polymer coating containing at least two polymers is used so that the properties of the super-hydrated membrane coating, such as the rate of dissolution and the size and amount of pores in the coating, can be controlled.

The size of the pores, created when the soluble component dissolves, may be altered by patterning the coating in such a way as to ensure the soluble component is only in certain spots and in certain amounts so that once the soluble component dissolves away the pores are of a desired size.

Figure 4:
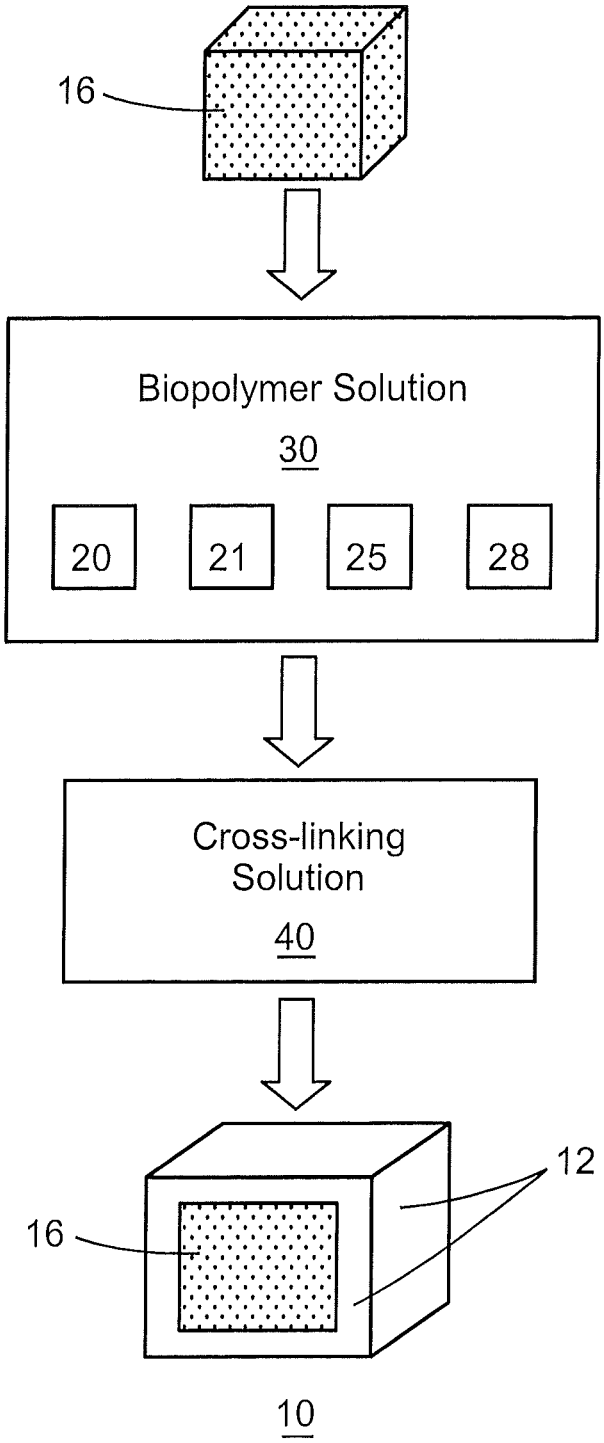
FIG. 4 is a simplified illustration of an exemplary ionic cross-linking coating method using two polymers.

As illustrated in FIG. 4, a portion of tobacco material 16 is shaped. The tobacco material 16 may be molded in any shape to create a preform. The tobacco material 16 is preferably pressed or molded in a manner that does not remove moisture from the tobacco, e.g., for MST, using light pressure to maintain about 50% to 55% moisture content of the tobacco material 16. The moist tobacco can be molded in a large enough shape to provide moist tobacco users with a desired mouth feel of the product.

In an embodiment, the tobacco material 16 is then dipped in a polymer solution 30 containing two different polymers dissolved in water. Preferably, a chemically cross-linkable polymer and a non-cross-linkable polymer are used.

Because moist tobacco naturally contains salts such as calcium ions, the calcium ions preferably cross-link with the cross-linkable polymer to form a skin or shell on the inside of the coating once the tobacco material has been contacted with the two polymer solution. Later, when the coating is exposed to a cross-linking agent, an outer skin or shell can form on the coating. The inner and outer skins or shells provide a moisture barrier for the tobacco and the soluble portion of the coating. Preferably, the shells/skins are formed of a discontinuous, cross-linkable polymer with regions of the non-cross-linkable polymer incorporated therein.

In a preferred embodiment, the concentration of the film forming polymer solution 30 is about 0.5 wt % to 20 wt % polymer in the solution. Most preferably, the concentration of the film forming polymer solution 30 is about 1 wt % to 1.5 wt % of the polymer components with the balance being water.

The concentration of the polymer solution 30 determines the thickness of the coating membrane. The thickness of the coating can in turn affect how quickly the soluble component of the coating dissolves in a user's mouth. The coating is a moist, gel-like coating when formed and the moistness is preferably retained until use. Preferably, the coated tobacco product is hermetically sealed in suitable packaging to prevent moisture in the tobacco and coating from evaporating.

If the coating is peeled off of the tobacco product and completely dried, the coating is preferably about 0.02 mm to 1.0 mm thick. More preferably, when the coating is completely dried, it is about 0.08 mm to 0.14 mm thick. In a most preferred embodiment, the coating when completely dried is about 0.11 mm thick. It should be noted that the coating is not intended to be dried, but rather retains a high moisture content.

In a preferred embodiment, the weight of the coating when completely dried is about 0.013 g for a coated tobacco product weighing about 2.5 g. In contrast, the weight of the coating for a coated tobacco product weighing about 2.5 g, when the coating is at the preferred moisture content is about 0.15 g.

After coating the tobacco material 16 with the film forming polymer solution 30, cross-linking is conducted with a cross-linking solution 40 including a monovalent metal ion salt or a bivalent metal ion salt.

Preferably, the cross-linking solution contains a bivalent metal ion salt. Most preferably, the cross-linking solution includes calcium lactate, which is commonly used in the food industry. In one embodiment, the cross-linking solution is a 2.0 wt % calcium lactate solution.

The tobacco product 10 is then exposed to air or patted dry to evaporate excess moisture. The tobacco product 10 is not dried so that moisture content remains high in the super-hydrated coating.

By using both a non-cross-linkable polymer and a cross-linkable polymer, the porosity and strength of the super-hydrated membrane coating can be controlled. For instance, the dissolution rate of the resulting super-hydrated membrane coating 12 can be altered by modifying the specific proportion of cross-linked to non-cross-linked polymers. In a preferred embodiment, the coating contains 10 to 90 wt % of the cross-linked polymer. Preferably, the proportion of cross-linked polymer in the coating is 60 to 70 wt %.

In another embodiment, the polymer solution and the cross-linking solution can be patterned, overprinted, or sprayed onto the tobacco material preform to form a network having a soluble component and an insoluble component. The polymer solution may include a chemically, cross-linkable polymer and a non-cross-linkable polymer. Alternatively, the polymer solution may include a single chemically, cross-linkable polymer. When a single polymer is used, the cross-linking solution may be selectively sprayed to leave some portions of the coating non-cross-linked and soluble. The soluble component of the coating may dissolve, leaving a porous network of insoluble component in place to maintain coherence of the tobacco material 16, while allowing the free flow of saliva in the user's mouth.

In an embodiment, the process may be automated. For instance, the coating step may occur via spraying the polymer solution 30 and the cross-linking solution 40 alternately onto a preformed portion of tobacco material 16 to create a cross-linked, thin, super-hydrated membrane coating 12 of a desired thickness.

In an embodiment, tobacco-based polymers may be substituted for non-tobacco sourced materials in the coating. Flavorful tobacco compounds may be extracted from the tobacco based material in order to modify the tobacco flavor character to initial in-mouth experience. However, such high extraction is unnecessary.

In one embodiment, additional dissolvable tobacco such as tobacco extracts or colloidal encapsulated tobacco can be added to the coating to increase the initial tobacco flavor in the first stages of the dissolution of the super-hydrated membrane coating.

Fillers may be added to the coating to make the coating opaque. Colorants may also be added to alter the color of the coating.

The following examples are exemplary and are not meant to limit any aspects of the embodiments disclosed herein.

Example 3

To form a super-hydrated membrane coating by ionic cross-linking of two biopolymers, a round bottom flask was charged with 1.0 g alginate, 0.5 g starch and 98.5 mL of deionized water. The mixture was stirred and heated to about 50° C. to 100° C. to dissolve the biopolymers The solution was cooled down to room temperature and then transferred to a plastic pan. 2.5 g of moist tobacco was first molded into a rectangular shape and then dipped into the above described solution. A cross-linking solution of 2.0 wt % calcium lactate in water was prepared. The coating on the moist tobacco was then cross-linked with the 2.0 wt % cross-linking solution. The sample was exposed in air to evaporate moisture until the weight of the coated moist tobacco product reached about 2.5 g to 2.8 g.

Example 4

To form a super-hydrated membrane coating by ionic cross-linking of two biopolymers, a round bottom flask was charged with 1.0 g alginate, 0.5 g gum arabic and 98.5 mL of deionized water. The mixture was stirred and heated to about 50° C. to 100° C. to dissolve the biopolymers. The solution was cooled down to room temperature and then transferred to a plastic pan. A cross-linking solution of 2.0 wt % calcium lactate in water was created. 2.5 g of moist tobacco was first molded into a rectangular shape and then dipped into the above described solution. The coating on the moist tobacco was then cross-linked with the 2.0 wt % cross-linking solution. The sample was exposed in air to evaporate moisture until the weight of the coated moist tobacco product reached about 2.5 g to 2.8 g.

Example 5

To form a super-hydrated membrane coating by ionic cross-linking of two biopolymers, a round bottom flask was charged with 1.0 g alginate, 0.5 g soy protein and 98.5 mL of deionized water. The mixture was stirred and heated to about 50° C. to 100° C. to dissolve the biopolymers. The solution was cooled down to room temperature and then transferred to a plastic pan. A cross-linking solution of 2.0 wt % calcium lactate was prepared. 2.5 g of moist tobacco was first molded into a rectangular shape and then dipped into the above described biopolymer solution. The coating on the moist tobacco was then cross-linked with the 2.0 wt % cross-linking solution. The sample was exposed in air to evaporate moisture until the weight of the coated moist tobacco product reached about 2.5 g to 2.8 g.

While the foregoing has been described in detail with reference to specific embodiments thereof, it will be apparent to one skilled in the art that various changes and modification may be made, and equivalents thereof employed, without departing from the scope of the claims.

We claim:

1. A method of forming a moist tobacco product for oral enjoyment having a semi-dissolvable, super-hydrated membrane coating, the method comprising:

molding a portion of moist tobacco material;

contacting said portion of moist tobacco material with a multi-component polymer solution to form a coating on said portion of moist tobacco material; and cross-linking said coating to form a semi-dissolvable, super-hydrated membrane coating on the molded moist tobacco material, wherein said semi-dissolvable, super-hydrated, membrane coating comprises an insoluble component and a soluble component.

2. The method of claim 1, wherein said polymer solution includes a chemically, cross-linkable polymer and a non-cross-linkable polymer.

3. The method of claim 2, wherein said chemically, cross-linkable polymer and said non-cross-linkable polymer are polysaccharides.

4. The method of claim 2, wherein said cross-linkable polymer is selected from the group consisting of alginate, pectin, carrageenan, modified polysaccharides with cross-linkable functional groups, and combinations thereof.

5. The method of claim 2, wherein the proportion of cross-linkable polymer in the coating is about 10% to 90% by weight.

6. The method of claim 1, wherein the cross-linking comprises exposing the coating to a solution consisting of a cross-linking agent in water.

7. The method of claim 6, wherein said cross-linking agent is a bivalent metal ion salt, and said bivalent metal ion salt is calcium lactate.

8. The method of claim 6, wherein: (a) the molded portion of tobacco material is sprayed with said polymer solution; (b) the molded portion of tobacco material is dipped into said polymer solution; (c) the concentration of said polymer solution is about 0.5 wt % to 20 wt %; (d) the concentration of said polymer solution is about 1 wt % to 2 wt %; (e) the cross-linking agent is applied to the coating in a pattern and/or (f) the moist tobacco is moist smokeless tobacco.

9. The method of claim 2, wherein said non-cross-linkable polymer is selected from the group consisting of dextrin, gum arabic, guar gum, chitosan, polyvinyl alcohol, polylactide, soy protein, whey protein, and combinations thereof.

10. The method of claim 1, wherein the semi-dissolvable, super-hydrated, membrane coating includes at least one non-tobacco flavorant incorporated in the soluble component so as to provide rapid release.

11. The method of claim 1, wherein the semi-dissolvable, super-hydrated, membrane coating includes at least one non-tobacco flavorant incorporated in the insoluble component so as to provide slow release and prolonged release.

12. The method of claim 1, wherein the semi-dissolvable, super-hydrated, membrane coating includes at least one non-tobacco flavorant incorporated in both the insoluble and soluble components so as to provide prolonged release.

13. The method of claim 1, wherein said semi-dissolvable, super-hydrated membrane coating further comprises at least one sweetener.

14. The method of claim 1, wherein said semi-dissolvable, super-hydrated membrane coating further comprises at least one chemesthesis agent.

15. The method of claim 1, wherein said semi-dissolvable, super-hydrated membrane coating further comprises a tobacco extract.

16. The method of claim 1, wherein said moist tobacco material includes at least one humectant.

17. The method of claim 1, wherein said moist tobacco material is completely disintegrable in the mouth.

18. The method of claim 1, wherein said moist tobacco product weighs about 1.0 g to 4.0 g.

19. The method of claim 1, further comprising drying the moist tobacco product and said super-hydrated membrane coating is about 0.01 mm to 3.0 mm thick when completely dried.

20. The method of claim 1, wherein moist tobacco material has a moisture content of at least about 30%, the moist tobacco product is soft and flexible so as to conform to the shape of an oral cavity when placed therein, and the membrane comprises a single layer having an inner surface in contact with the tobacco material and an outer surface which is exposed to saliva and tissue in the oral cavity when placed therein.

* * * * *